US010966528B1

(12) United States Patent
Johnson

(10) Patent No.: US 10,966,528 B1
(45) Date of Patent: Apr. 6, 2021

(54) SPRING STOOL

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 0 days.

(21) Appl. No.: 16/535,788

(22) Filed: Aug. 8, 2019

(51) Int. Cl.
*A47C 1/02* (2006.01)
*A47C 3/22* (2006.01)
*A47C 7/00* (2006.01)

(52) U.S. Cl.
CPC ..... *A47C 3/22* (2013.01); *A47C 7/004* (2013.01); *A47C 7/006* (2013.01)

(58) Field of Classification Search
CPC ..... A47C 9/002; A47C 3/026; A47C 3/22; A47C 7/004; A47C 3/0252; A47C 9/007
See application file for complete search history.

(56) References Cited

U.S. PATENT DOCUMENTS 889,637 A 6/1908 Powell
1,070,278 A 8/1913 McKinney
1,377,332 A 5/1921 Franz
1,963,053 A * 6/1934 Powers ..... A47C 23/0438 5/256
2,048,148 A * 7/1936 Stoll ..... A47C 3/0252 248/583
2,298,230 A * 10/1942 Radke ..... A47C 3/026 248/565
2,494,094 A 1/1950 Horstman
2,525,670 A * 10/1950 Hamilton ..... A47C 7/26 5/402
2,879,960 A * 3/1959 Mortimer ..... G11B 33/02 248/560
3,796,460 A * 3/1974 Potchen ..... B62J 1/02 297/211
4,099,697 A 7/1978 Van Schuckmann
4,739,986 A * 4/1988 Kucharik ..... A63B 23/08 482/146
4,932,719 A 6/1990 Gonzales
5,355,550 A * 10/1994 Yang ..... B60B 33/0002 16/35 R
5,524,967 A * 6/1996 Glockl ..... A47C 3/02 248/372.1
5,909,925 A 6/1999 Glockl
5,921,628 A * 7/1999 Glockl ..... A47C 9/025 297/338
6,003,944 A * 12/1999 Glockl ..... A47C 3/18 297/337
6,585,315 B1 * 7/2003 Vail ..... A47C 9/08 297/186

(Continued)

*Primary Examiner* — Shin H Kim
(74) *Attorney, Agent, or Firm* — Booth Udall Fuller, PLC

(57) ABSTRACT

A stool can include a base including at least three legs with each leg including a non-slip member and a spring-loaded caster. A lower helical spring may be coupled to the base. A connecting member may comprise a first end coupled to the lower helical spring, a second end opposite the first end, and a central axis that extends between the first end and the second end. An upper helical spring may be coupled to the second end of the connecting member. A rotational joint may be coupled to the upper helical spring. A seat may be coupled to the rotational joint and configured to rotate about the central axis of the connecting member. The base, lower helical spring, upper helical spring, rotational joint, and seat may share a common vertical axis with the central axis of the connecting member when at rest.

20 Claims, 12 Drawing Sheets

(56) References Cited

U.S. PATENT DOCUMENTS

| | | | | |
|---|---|---|---|---|
| 7,081,075 | B2 | 7/2006 | Sachs | |
| 7,806,479 | B2 | 10/2010 | Jensen et al. | |
| 8,066,624 | B1 | 11/2011 | Stroup | |
| 9,016,786 | B2 * | 4/2015 | Glockl | A47C 3/22 297/313 |
| 9,526,341 | B2 * | 12/2016 | Glockl | A47C 3/026 |
| 9,770,107 | B2 * | 9/2017 | Glockl | A47C 3/18 |
| 9,894,998 | B2 * | 2/2018 | Walser | A47C 7/008 |
| 10,518,578 | B1 * | 12/2019 | Spektor | B60B 33/045 |
| 2011/0095586 | A1 * | 4/2011 | Fernandez | A47C 3/30 297/344.18 |
| 2017/0042334 | A1 * | 2/2017 | Mengshoel | A47C 3/027 |
| 2018/0344033 | A1 * | 12/2018 | Walser | A47C 3/22 |
| 2019/0200769 | A1 * | 7/2019 | Aono | A47C 7/14 |
| 2020/0001128 | A1 * | 1/2020 | Hume | A63B 23/0405 |

* cited by examiner

SPRING STOOL

TECHNICAL FIELD

This disclosure relates to a stool or seat and a method for making and using the same.

BACKGROUND

Today's workforce, particularly in industrialized knowledge-based or information-based economies, spend several hours (3-4) each day seated, such as at a desk working with computers, phones, or both. In some cases, most of a worker's day (such as 6-8 hours) may include performing work while seated or at a desk. Being sedentary or sitting for extended periods of time, as indicated above, can produce adverse health effects for workers.

To improve workers' health, various attempts have been made to ameliorate the situation, including more ergonomic chairs, standing desks, standing desks with objects to lean on or stand on (such as cushions or pads), and walking treadmills near desks.

SUMMARY

A need exists for an improved stool or seat. Accordingly, in an aspect, a stool can comprise a base comprising at least three legs with each leg comprising a non-slip member. A spring-loaded caster may be coupled to each of the at least three legs. A lower helical spring may be coupled to the base. A connecting member may comprise a first end coupled to the lower helical spring, a second end opposite the first end, and a central axis that extends between the first end and the second end. An upper helical spring may be coupled to the second end of the connecting member. A rotational joint may be coupled to the upper helical spring. A seat may be coupled to the rotational joint and configured to rotate about the central axis of the connecting member. The base, lower helical spring, upper helical spring, rotational joint, and seat may share a common vertical axis with the central axis of the connecting member when at rest.

Particular aspects of the stool may comprise a lateral stiffness s of the lower helical spring being greater than a lateral stiffness s of the upper helical spring, and a spring constant k of the lower helical spring being less than a spring constant k of the upper helical spring. The connecting member may further comprise an adjustable length that adjusts a height of the seat. The connecting member may further comprise a clamp collar and handle coupled to a top of lower helical spring such that a portion of connecting member may extend into an open center of lower helical spring to reduce a length of the connecting member disposed between the clamp collar and the seat to reduce the height of the seat. The seat may further comprise a lip to facilitate movement or positioning of the stool by a user. Spring-loaded casters may be configured to retract when a user is seated on the stool to allow the non-slip feet to engage with the ground and prevent the stool from rolling. The lower helical spring may be configured to tilt in a first direction when loaded by a user, and the upper helical spring may be configured to counter-tilt in a second direction substantially opposite to the first direction.

In an aspect, a stool may comprise a base, a lower helical spring coupled to the base, and a connecting member comprising a first end coupled to the lower helical spring, a second end opposite the first end, and a central axis that extends between the first end and the second end. An upper helical spring may be coupled to the second end of the connecting member. A rotational joint may be coupled to the upper helical spring. A seat may be coupled to the rotational joint such that the seat rotates about the central axis of the connecting member, and the base, lower helical spring, upper helical spring, rotational joint, and seat share a common vertical axis with the central axis of the connecting member when at rest.

Particular aspects of the stool may comprise a lateral stiffness s of the lower helical spring being greater than a lateral stiffness s of the upper helical spring. The base may comprise at least three legs comprising non-slip feet. The base may comprise at least one spring-loaded caster. The connecting member may further comprise an adjustable length that adjusts a height of the seat. The connecting member may further comprise a clamp collar and a handle coupled to a top of the lower helical spring such that a portion of connecting member may extend into an open center of the lower helical spring to reduce a length of the connecting member disposed between the clamp collar and the seat to reduce the height of the seat. The seat may further comprise a lip to facilitate movement or positioning of the stool by a user.

In an aspect, a stool may comprise a base, a lower helical spring coupled to the base, and a connecting member comprising a first end coupled to the lower helical spring, a second end opposite the first end, and a central axis that extends between the first end and the second end. An upper helical spring may be coupled to the second end of the connecting member. A seat may be coupled to the upper helical spring.

Particular aspects of the stool may comprise a spring constant k of the lower helical spring being less than a spring constant k of the upper helical spring. The base may comprise at least three legs comprising feet, and at least one spring-loaded caster coupled to the base. A rotational joint coupled to the upper helical spring, and the seat coupled to the rotational joint such that the seat rotates about the central axis of the connecting member. The connecting member may further comprise an adjustable length that adjusts a height of the seat. The connecting member may further comprise a clamp collar and a handle coupled to a top of the lower helical spring such that a portion of the connecting member may extend into an open center of the lower helical spring to reduce a length of the connecting member disposed between the clamp collar and the seat to reduce the height of the seat.

DETAILED DESCRIPTION

Figure 1:
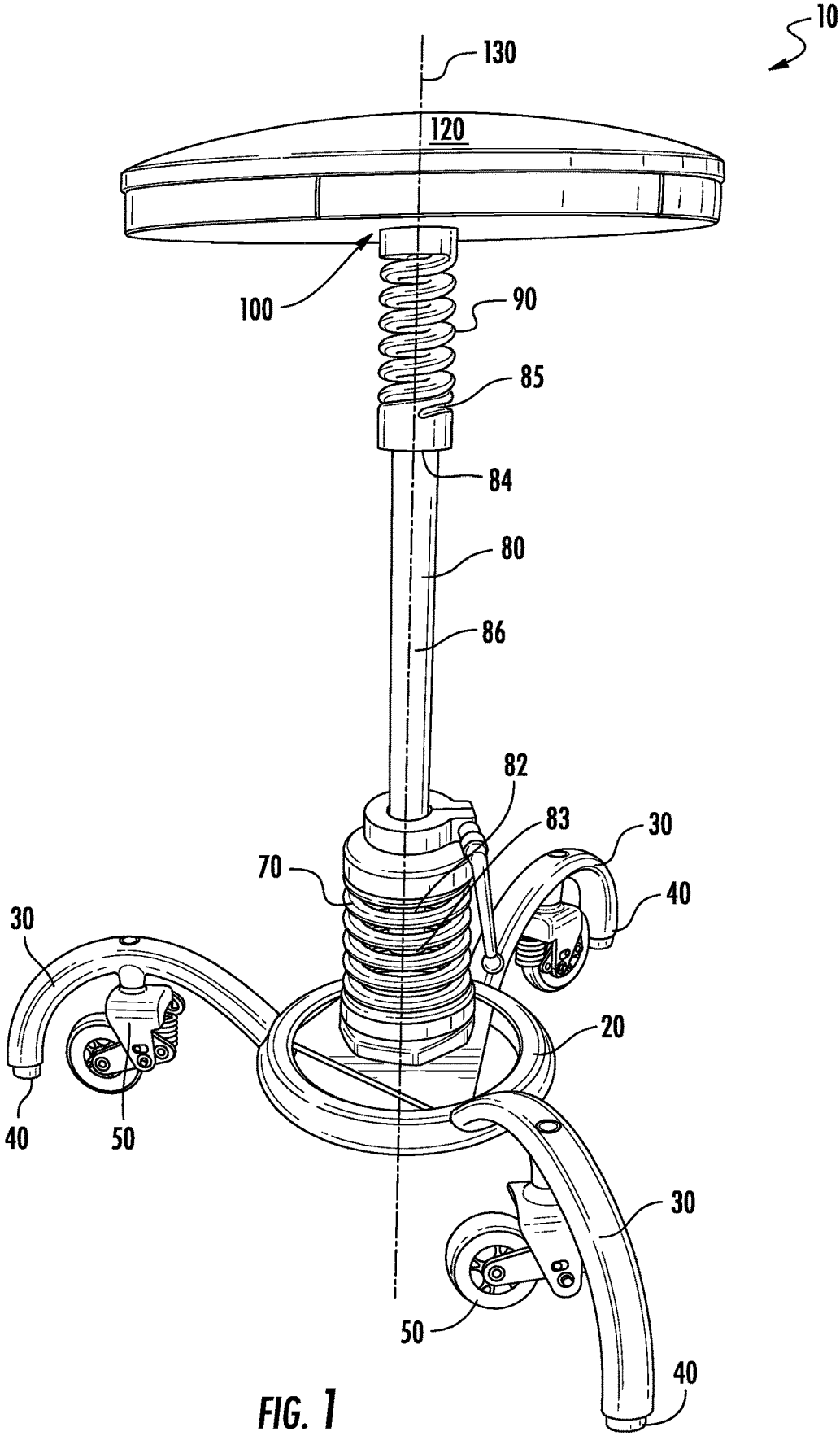
FIG. 1 shows a perspective view of an embodiment of the spring stool.

This disclosure, its aspects and implementations, are not limited to the specific material types, or other system component examples, or methods disclosed herein. Many additional components, manufacturing and assembly procedures known in the art consistent with seating manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

As noted above, many workers spend several hours a day—or more—seated or working at a desk. Applicant acknowledges the detrimental health effect to workers that often results from working at a desk or from being seated for extended periods of time with conventional seats, as well as the difficulties present with standing. Applicant has also noted that previous attempts by chair-designers and chair-makers to address health concerns have resulted in the creation of various types of "ergonomic" chairs that support or conform to the user's body to increase user comfort. However, Applicant has discovered that the creation of more ergonomic designs has, in many cases, deteriorated user health rather than ameliorating previous problems. In particular, the increased support of an ergonomic chairs may prevent or discourage movement, which over time can lead to the weakening of the user's leg, hip, and back muscles, as well as increase nerve and circulation problems.

In response to the health problems associated with chairs, many designer and manufacturers now promote standing desks, which either include no chair or some type of support against which the user may lean. However, standing or leaning for long periods of time may also be detrimental to the health of a user. In addition, tasks requiring high levels of concentration, such as computer programming or CAD design, are often more difficult for many people to perform when standing rather than sitting.

Over the years, some designers and manufacturers have incorporated one or more springs, elastic flexures, and inflatable elements in their chair designs. However, previous designs and products have failed to create solutions that encourage proper motion while seated. Therefore, the present disclosure sets forth a new design for a seating apparatus, chair, or spring stool 110, which is shown and described herein, and facilitates the types of movement that are beneficial in preserving and maintaining the health of a user.

FIG. 1 shows a perspective view of an embodiment of a spring stool 10 that includes a base 20 and may further comprise a plurality of legs 30, such as three or more legs 30. The base 20 (including one or more of the legs 30—or each of the legs 30) may comprise a non-slip member, foot, or contact surface 40. In other instances, such as that shown and described below with respect to FIGS. 7A and 7B, the non-slip member 40 may be directly applied to the base 20, such as when no legs 30 are present. A caster, wheel, or spring-loaded caster 50 may be coupled to the base 20. In some instances, one or more casters may be coupled to one or more (such as at least one) of the legs 30, including each of the legs 30. A lower helical spring 70 may be coupled to the base 20. A connecting member, vertical support or pole 80 may be provided that comprises a first end or lower end 82 that is coupled to the lower helical spring 70. The connecting member 80 may also comprise a second end or upper end 84 opposite the first end 82, and may further comprise a central axis 86 that extends between the first end 82 and the second end 84. The first end 82 and the second end 84 as used herein refer both to the terminal surfaces (first terminal surface 83 and second terminal surface 85) of the connecting member 80 as well as short distance from the respective end 82, 84 away from the terminal surface and along the length or central axis 86 of the connecting member 80. As such, the "short distance" from the terminal surfaces 82, 84 may comprise a distance of 0-5 centimeters (cm), 1-10 cm, or a distance that is a percentage of the total length L of the connecting member 80, such as percentage in a range of 0-5%, 1-10%, 1-20%, 1-30%, 1-40%, or 1-50% of the total length L of the connecting member 80. The length of the connecting member 80 may be measured along the central axis 86 of the connecting member and extend between the first end 82 (or terminal surface 83) and the second end 84 (or terminal surface 85).

An upper helical spring 90 may be coupled to the second end 84 of the connecting member 80. A rotational joint 100 may be coupled to the upper helical spring 90. A seat 120 may be coupled to the rotational joint 100 and be configured to rotate about the central axis 86 of the connecting member 80. The base 20, the lower helical spring 70, the upper helical spring 90, the rotational joint 100, and the seat 120 may all share a common vertical axis 130 with the central axis 86 of the connecting member 80 when the stool 10 (including the lower helical spring 70 and the upper helical spring 980) is at rest.

For ease of description, lower helical spring 70 and upper helical spring 90 may be collectively referred to generally as helical springs 91. Helical springs 91, whether referring to lower helical spring 70, upper helical spring 90, or both, may be made of any suitable metal such as stainless steel, steel, aluminum, or other suitable metal, as well as any other suitable material. Helical springs 91 comprise any spring that comprises a helical shape, such as a spiral shape or a shape of an object having a three-dimensional shape like that of a wire or length of material (of any cross section) wound (uniformly or not) in a single layer (or one or more layers) around a cylinder or cone (such as to form a conical spring). Thus, the helical shape of helical springs 91 may comprise shapes that are the same or similar to a corkscrew or spiral staircase. The cross-section of the wound or helical material forming the helical spring 91 may comprise a cross-section comprising a shape that is circular, square, octagonal, or a polygon comprising any number of sides. Helical springs 91 may be formed from flat wire (to form flat wire compression springs) or rectangular wire (to form a rectangular wire compression springs). The helical spring 91 shown in FIG.

Figure 3A:
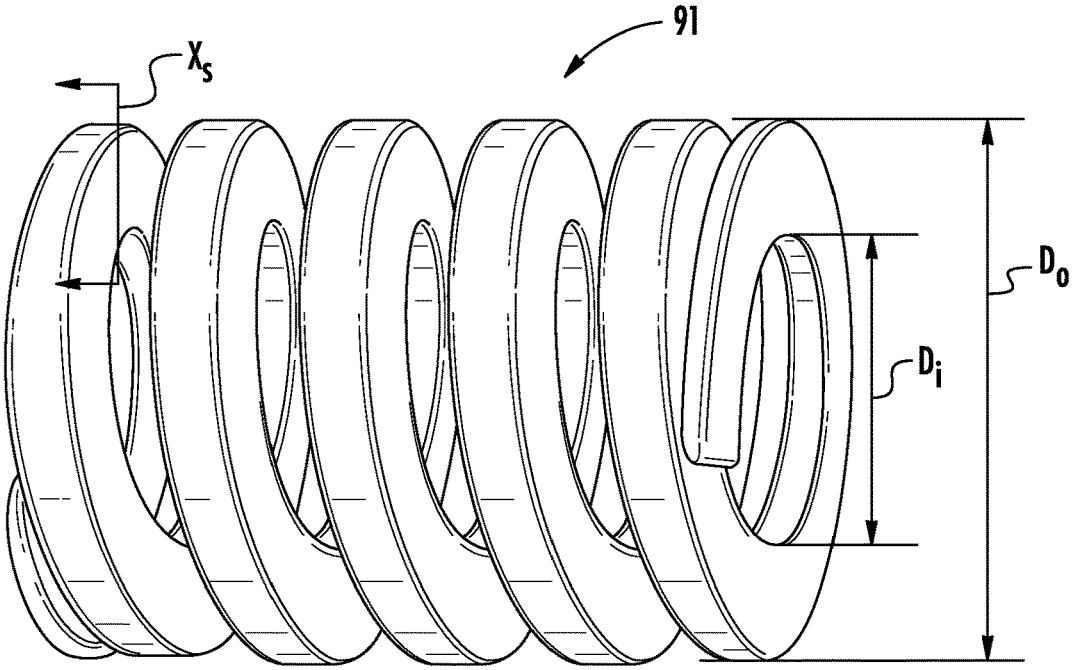
FIGS. 3A-3F show various types of springs.

3A provides an example of a flat wire or rectangular wire compression spring. As shown in FIG. 3A the helical spring 91 comprises a cross-sectional area or shape $X_s$ that is rectangular. Helical springs 91 may also comprise die springs. Helical springs 91 may also comprise more than one start or wire wound together, or formed from a spring material, e.g., a double helix or a triple helix instead of a single helix. Considered together therefore, helical springs 91 comprise coil springs 92, machined springs 93, and couplings 94 such as beam couplings, bellows couplings, and lattice couplings.

Coil springs 92, such as those shown in FIGS. 1-2C and 5A-5F, comprise a generally helical or conical shape and are made with a wire-like material or any material comprising a circular cross section. As such, coil springs 92 are a subset of helical springs 91, having a narrower range of cross-sectional shapes, namely circular. Coil springs 92 may comprise a helical shape that comprises a width or diameter $D_c$ (in the x-direction, the z-direction, or both) that remain constant or roughly constant along a height H of the stool 10 or length L of the connecting member 80 (i.e., in the y-direction). In other instances, the width Dc may vary along the height H. Coil springs 92 may also comprise more than one start or wire wound together, e.g., a double helix or a triple helix instead of a single helix.

Figure 3B:
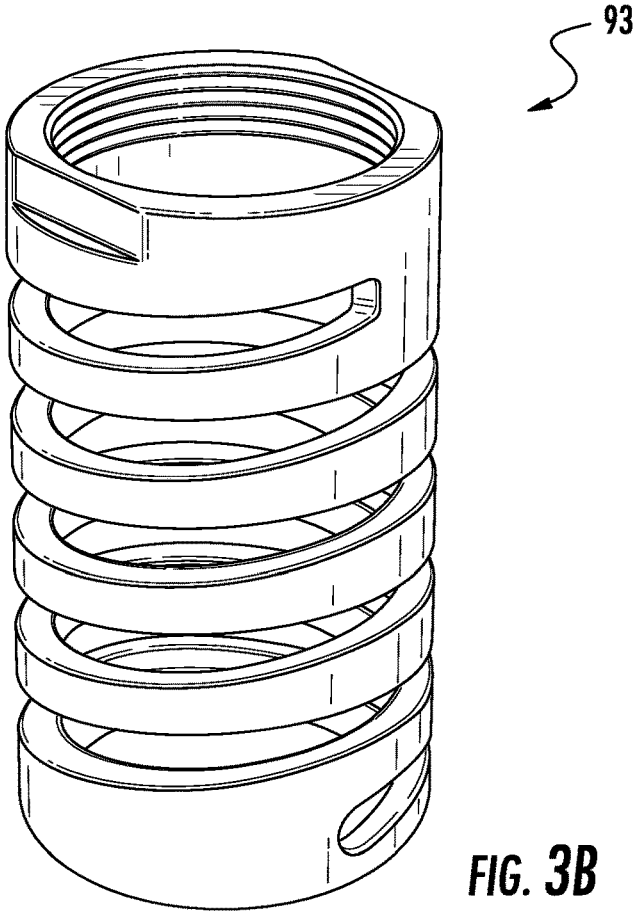
Figure 3C:
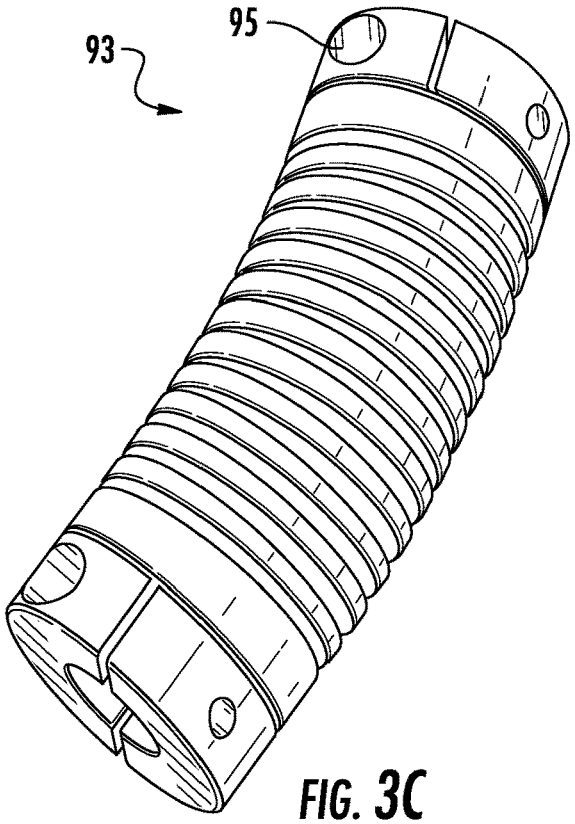
Figure 3D:
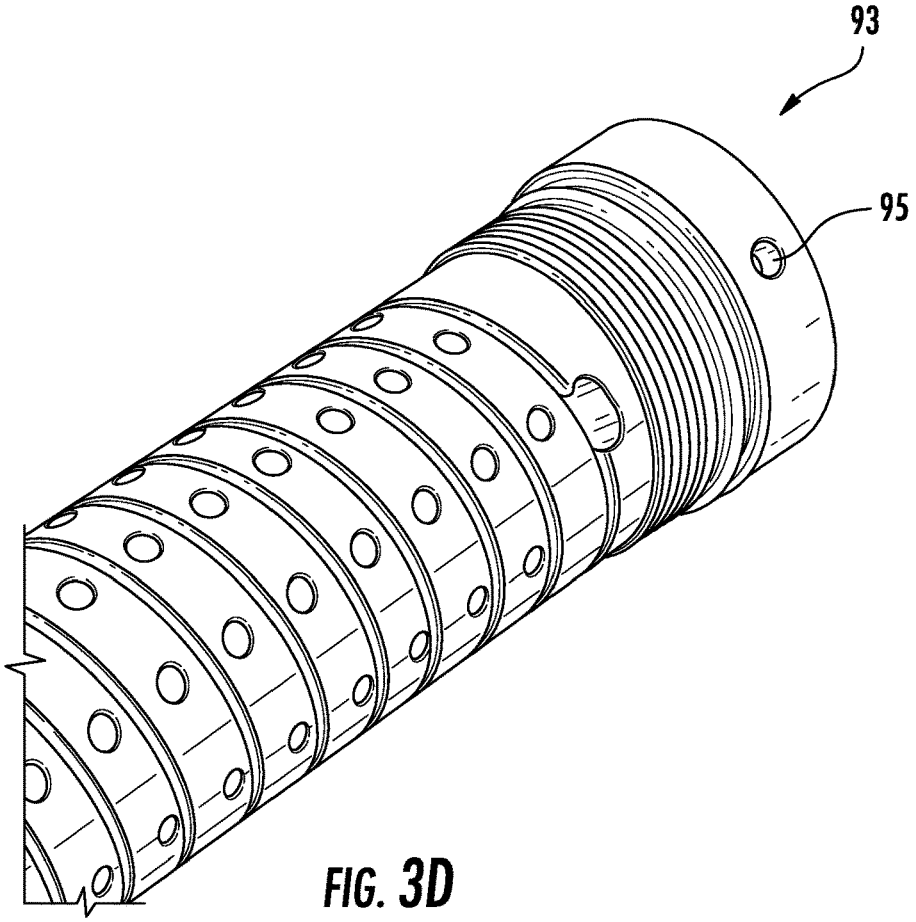

Helical springs 91 also comprise machined springs 93, such as those shown in FIGS. 3B-3D, and may have an appearance of material being wound around a cylindrical, conical, or other shaped form, but may instead be formed or machined from a solid block of material without being wound or formed from wire or other elongate material. Machined springs 93 may comprise more than one start, e.g., a double helix or a triple helix instead of a single helix. The multiple starts of helical spring 91 may be contained within a same footprint in the x-z plane, or may be nested or in concentric expanding layers with respect to each other as seen in the x-y plane. Machined springs 93 may also include other components, such as a connection member or adjusting mechanism 95 integrally machined into the machined spring 93.

Figure 3E:
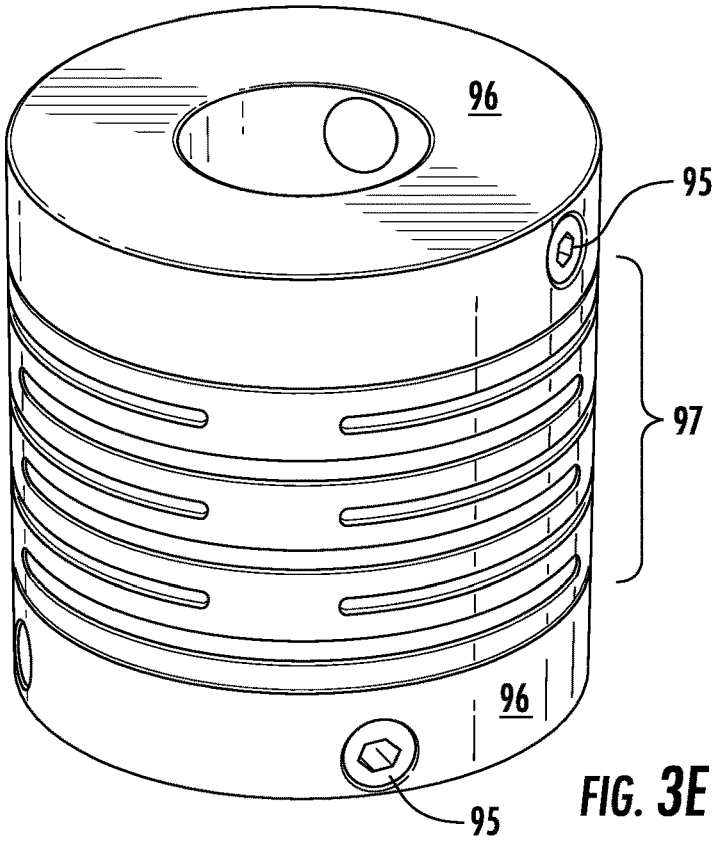
Figure 3F:
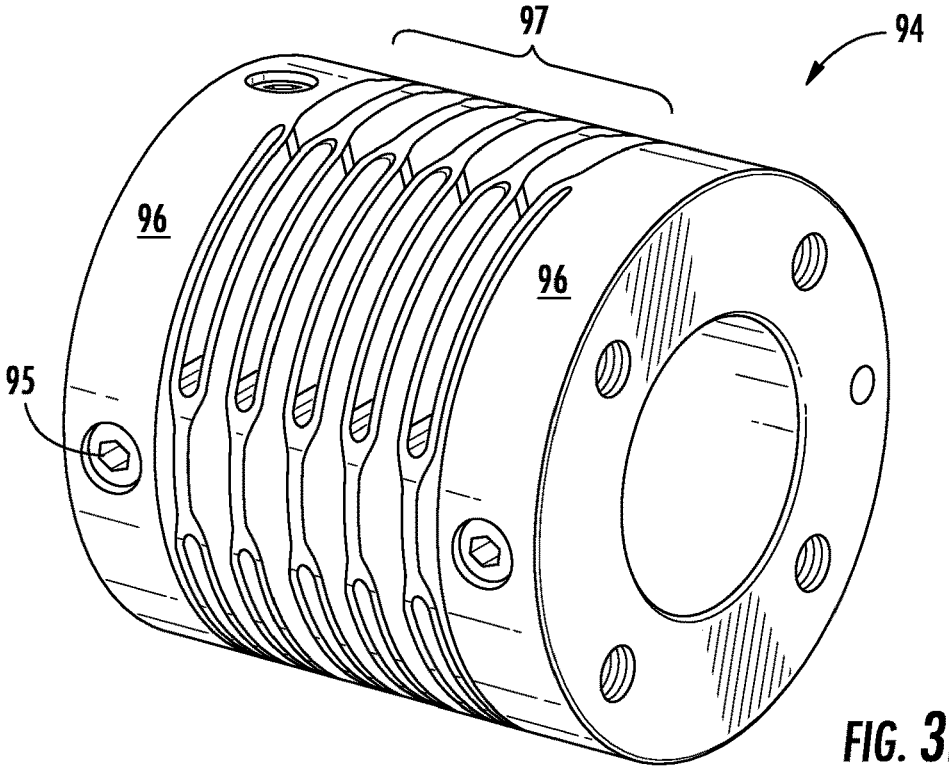

Helical springs 91 also comprise couplings, beam couplings, bellows couplings, and lattice couplings 94. The coupling 94 may be a beam coupling, as shown in FIG. 3E. The coupling 94 may also be a bellows coupling as shown in FIG. 3F. As a bellows coupling the couplings 94 may comprise twin coupling ends or hubs 96 coupled to a corrugated tube or coupling body 97, and may be made from a suitable metal such as stainless steel and may be hydroformed, welded, or otherwise suitably formed to create corrugations, ribs, or folds, such as from multiple beams or discs.

Figure 2C:
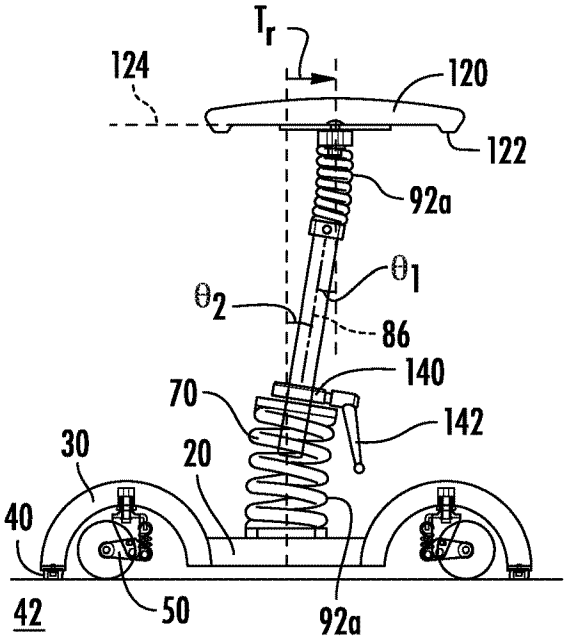
FIGS. 2A-2C show various movements of the spring stool.
Figure 2B:
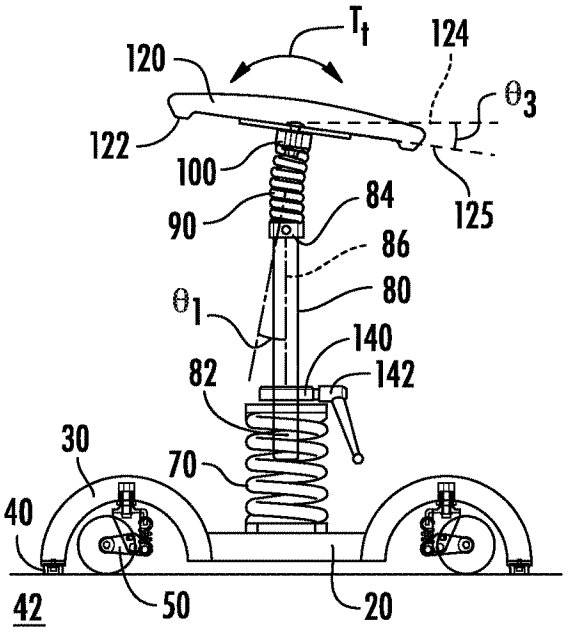
Figure 2A:
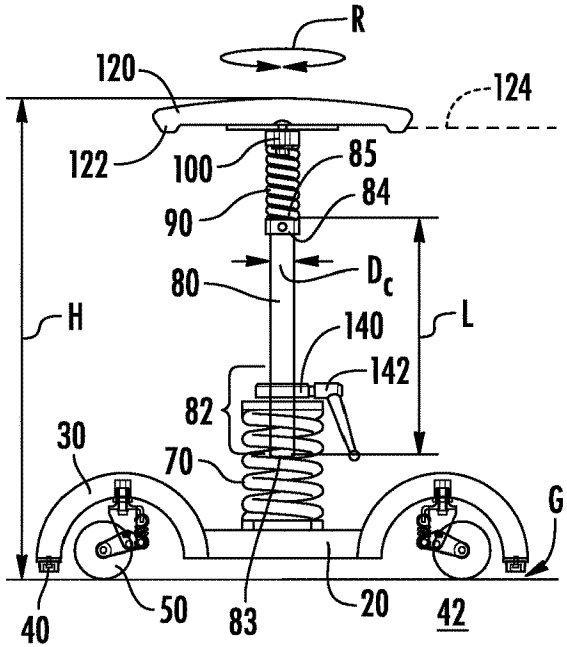

FIGS. 2A-2C show the spring stool 10 provides different types of motion, movement, and positioning, to facilitate a desired location of a user 300 on the stool 10, a desired movement of or for the user 300, and desired or preferred interactions between the user 300 and their environment. While FIGS. 5A-5F show the body mechanics of user 300 changing with respect to the movements of the stool 10, FIGS. 2A-2C show movements of the stool 10, and various degrees of freedom without the user 300 being shown on the stool 10. However, a person of ordinary skill in the art (POSA) will understand that the user 300 may be present for, and take advantage of, the motion and degrees of freedom presented in FIGS. 2A-2C.

FIG. 2A shows a side profile view of the seat 120 in the x-y plane. The seat 120 can rotate in the x-z plane with respect to the rest of the stool 10 at the rotational joint 100 when the stool 10 is at rest. In other instances, when the lower helical spring 70 and the upper helical spring 90 are loaded, repositioned, or otherwise moved from their "at rest," unloaded, or nominal positions, the rotation of the seat 120 can occur in any number of other desired planes. The rotational joint 100 can comprise ball bearings or other bearings disposed between two plates, an axel or pin within or without a sleeve, or any other suitable structure known in the art that facilitates rotation of the seat with respect to the rest of the stool 10, or one or more of the upper helical spring 90, the connecting member 80, the lower helical spring 70, and the base 20. In some instances, the rotational joint 100 will be positioned between the seat 120 and the upper helical spring 90. In other instances, the rotational joint 100 may be disposed between the upper helical spring 90 and the connecting member 80, or at any other desirable position along common vertical axis 130. The rotational joint 100 allows for the rotation R of the seat 120, which in turn provides for the rotation of the user 300 when seated on the stool 10.

The seat 120 may be made of one or more pieces or layers of wood, plastic, metal, fiberglass, carbon fiber, or any other suitable material. The seat 120 may also comprise one or more layers of padding or cushioning for comfort, as well as holes, openings, or mesh for ventilation and to facilitate airflow. In some instances, the seat 120 or a portion of the seat 120 may contain a fluid or gel, and may be inflatable so as to hold a variable and desired mount of air-pressure such that core or torso muscles 302 of a user 300 may be more fully engaged, improving posture and strengthening rather than weakening the core 302 of the user 300. When the seat comprises a compliant or fluid filled chamber or area, the air-pressure or amount of compliance or deformation provided to the user 300 may be adjusted to suit a preference or need of the user 300.

The seat 120 may comprise an outline, footprint, or form-factor that is circular, oval, square, rectangular, or any other desirable shape. The seat 120 may comprise a lip, ridge, or channel 122 that provides a handle, fingerhold, or area for a user 300 to grab and move the stool 10 to a desired position. In some instances, the lip 122 can be located at an underside of the seat 120, such as along a perimeter, circumference, or edge of the seat 120. In some instances, the lip 120 can be a raised surface extending away from a surface of the seat 120, such as away from the surface of the seat 120. In other instances, the lip 120 can be recessed within the surface of the seat 120. The lip 122 can be positioned in the lower surface, upper surface, or any desirable surface of the seat 120.

As shown in FIG. 2A, the stool 10 may further comprise a clamp collar or adjustment mechanism 142 that can tighten and loosen to allow for a height (H) of the seat 120 to be increased or decreased with respect to the floor or the surface 42 on which the stool 10 or base 20 of the stool 10 is resting. By allowing the height H of the seat 120 to increase and decrease, user 300 may be of a variety of heights and still be comfortably accommodated, allowing for legs of the user 300 to reach and be supported by the floor 42, the base 20, or both. In some instances, the clamp collar 142 may be positioned between the lower helical spring 70 and the connecting member 80. The adjustment of height H may be accommodated by providing the lower helical spring 70 with an inner diameter $D_i$ that is larger than the diameter (or outer diameter) $D_c$ of the connecting member 80 such that the connecting member can slide up and down through the lower helical spring 70, with the first end 82 of the connecting member disposed within the lower helical spring 70.

In some instances, the connecting member 80 may comprise a telescoping member to facilitate height adjustment. In other instances, the connecting member 80 may slide within the upper helical spring 90, with the clamp collar 142 being disposed at or near an interface of the upper helical spring 90 and the second end 84 of the connecting member 80. While the connecting member 80 may comprise a circular cross-sectional shape, as implied by the diameter of the connecting member $D_c$, the connecting member may also comprise any suitable cross-sectional shape, including oval, square, rectangle, or others, and may match, fit, or nest within or with the cross-sectional shape of the inner diameter $D_i$ of the lower helical spring 70. As such, when the cross-sectional shape connecting member 80 is not circular, a POSA will understand that the diameter of the connecting member $D_c$ will be broadly construed to include the largest dimension or width of the cross-sectional area.

FIG. 2A also shows that a gap G may exist between the non-slip member 40 (or leg 30) and the floor 42 when the stool 10 is free of weight, being unloaded or partially loaded by the user 300 or by other items. When the gap G exists, the non-slip member(s) 40 do not contact the floor 42, and the stool 10 is free to roll on casters 50 to be positioned at a desired location. FIGS. 2B and 2C show that when weight or force is applied in a downward direction to the stool 10, such as by the user 300 or other object seated on the seat 120, the spring-loaded casters 50 (shown and described in greater detail with respect to FIGS. 4A-4D) retract, are moved upward, or allow the stool 10 to descend lower to the floor 42, slightly decreasing the height H, until the base 20, legs 20, or non-slip member(s) 40 come in contact with the floor 42. When the non-slip feet 42 are in contact with the floor 40, the Gap G is reduced to zero, and the non-slip member(s) 40 prevent the stool 10 from rolling across the floor 42 to be repositioned. Instead, the lateral forces (forces in the x-z planes) that are applied to the stool 10 allow the stool 10 to tilt, as is shown with the tilt $T_t$ in FIGS. 2B and 2C.

FIG. 2B shows a side or profile view of the stool 10, similar to the view shown in FIG. 2A. FIG. 2B differs from FIG. 2A in that instead of showing the rotation R of seat 120, FIG. 2B shows tilt $T_t$ of seat 120, which in turn provides for the tilt of the user 300. The tilt $T_t$ may be measured as a third angle or angle theta-three ($\Theta_3$) that is the difference in angle between the seat 120 and the floor 42. In other words, the angle $\Theta_3$ can be measured as the difference between a horizontal centerline or plane 124 of the seat 120 (as measured when the seat 120 is parallel with the floor 42 when the stool 120 is at rest on a level surface), and the position of the tilted horizontal centerline or plane 125 of the seat 120 (as measured when the seat 120 is not parallel with the floor 42 when the stool 120 is tilted $T_t$ under lateral loading).

When at rest on a level surface of floor 42, an "axial" direction is synonymous with a vertical or y-direction, but when central axis 86 (or common vertical axis 130) is inclined away from the vertical or y-axis, the axial direction (central axis 86 or common vertical axis 130) still describes an axis of the stool 10 as it is tilted away from vertical.

FIG. 2C shows a side or profile view of the stool 10, similar to the views shown in FIGS. 2A and 2B. FIG. 2C differs from FIGS. 2A and 2B in that FIG. 2C shows the stool 10 can provide translational movement $T_r$. Translational movement $T_r$ may be provided by the lower helical spring 70 being configured to tilt in a first direction when, or while, the upper helical spring 90 is configured to counter-tilt in a second direction substantially opposite to the first direction. As shown in FIG. 2C, the lower helical spring 70 may tilt in a first direction at a first angle or angle theta-one $\Theta_1$. The upper helical spring 90 may counter-tilt in a second direction at a second angle or angle theta-two $\Theta_2$. The translational movement $T_r$ may be the sum of the lateral movement from the tilt at the angle theta-one $\Theta_1$ and the counter-tilt at the angle theta-two $\Theta_2$.

An amount of tilt $T_t$ or translational movement $T_r$ (such as in any x-y plane, tilted horizontal centerline or plane 125, or in a direction perpendicular to the central axis 86, the common vertical axis 130, or the y-axis) can be a function of the stiffness or flexibility of the springs 70, 90 and the amount of deformation per force applied to the springs 70, 90. In some instances, the upper helical spring 90 may be more flexible than the lower helical spring 70 to desirably enable advantageous tilting $T_t$ of the seat 120. The flexibility or lateral movement per unit force of the helical springs 91 may be referred to as the spring's torsional resistance or lateral stiffness. The following equation shows the relationship between the lateral stiffness "s" of coil springs 92 (made from round wire or coils comprising a circular cross section), which may include lower helical spring 70 and upper helical spring 90: s=k/(C*(0.294*(h/D)/\2+0.32)), where "C" is the coefficient determined by aspect ratio, "d" is the wire diameter, "D" is the spring diameter, "h" is the spring height, "G" is the shear modulus, and "N" is the number of active coils.

An amount of compression or axial movement of the springs 70, 90 (such as in a vertical direction, y-direction, along a central axis of the springs, the central axis 86, the common vertical axis 130, or in a direction perpendicular to the tilted horizontal centerline or plane 125) can be a function of the stiffness or flexibility of the springs 70, 90 and the amount of deformation per force applied to the springs 70, 90 in an axial direction, otherwise known as the spring constant k. In other words, the stiffness or flexibility of the springs 70, 90, or of any helical spring 91 or coil spring 92, in the axial direction (k) may be in a direction perpendicular, substantially perpendicular, orthogonal, or substantially orthogonal, to the directions of the lateral stiffness "s". The relationship between the spring constant "k" of coil springs 92 (made from round wire or coils comprising a circular cross section), which may include lower helical spring 70 and upper helical spring 90 is represented by the following equation: k=(G*d/\4)/(8*N*D/\3). In some instances, the spring constant k for the lower helical spring 70 may be, or may be about, in a range of 150-180 Newtons (N)/millimeter (mm), 164-170 N/mm, or 167 N/mm (955 pounds (lb)/inch (in)) and for the upper helical spring 90 the spring constant k may be, or may be about, in a range of 200-230 N/mm, 200-216 N/mm, or 213 N/mm (1217 lb/in). As used herein "about" means a percent difference in a range of 0-5%, 1-10%, 1-20%, or 1-30%.

Using helical springs 91 with the stiffnesses described above, the entire assembly or stool 10 (including the lower helical spring 70 and the upper helical spring 90) may compress just 10 mm for a 91 kg user 300 (or ⅜ in for a 200 lb user 300). However, variation in weights of intended users 300 and variation in distances between users 300 and their workstations, whether computer screens or other visual or manual tasks, may be compensated for by variation in stiffness of the springs 91 used in the stool 10. In any event, the user 300 may desirably experience the stool 10 as being or feeling very solid rather than bouncy or springy, especially in an axial direction, which may aid with the focus and task completion of user 300. In some instances, the upper helical spring 90 may be more flexible and have less lateral stiffness s than the lower helical spring 70, to desirably enable advantageous tilting $T_t$, translation $T_r$, or both, of seat 120. Examples of advantageous tilt $T_t$ and translation $T_r$ are shown and described with respect to FIGS. 5A-5F, which show the head 304 of the user 300 remaining stationary, while the torso 302 of the user 300 moves in response to the position of the seat 120, the position of the seat responding to the movement of the lower helical spring 70, the upper helical spring 90, and the user 300.

Both the lateral stiffness s and the compressive resistance or spring constant k will vary depending on the size and material properties of the helical spring 91, and will vary in different ways, as described in the equations included above. A coil spring 92 may comprise a high spring constant k (to minimize axial movement) while having a relatively low lateral stiffness s (to more easily allow radial movement), which may occur when height, diameter, or both the height and the diameter of the spring 91, 92 is sufficiently large. In some instances, the lower helical spring 70 may comprise a spring constant k that is lower than the spring constant k of the upper helical spring 90, while at the same time the lower helical spring 70 comprises a higher lateral stiffness s than the lateral stiffness of the upper helical spring 90. The lower helical spring 70 may comprise a lower spring constant k and a higher lateral stiffness s at least in part because of the larger coil diameter of the lower helical spring 70. As shown in the FIGs., the lower helical spring 70 may comprise a diameter that is larger than a diameter of the upper helical spring 90, which in turn may also facilitate height adjustment of connecting member 80 and aesthetics of the stool 10.

In some instances, such as when the lower helical spring 70 and the upper helical spring 90 have the same or about the same torsional resistance, lateral stiffness s, deformation, movement, or shift for a given force, angle theta-one $\Theta_1$ may be equal or substantially equal and opposite to angle theta-two $\Theta_2$. As used herein "substantially" means a percent difference in a range of 0-5%, 1-10%, 1-20%, or 1-30%. The counter-tilt or angle theta-two $\Theta_2$ may be equal and opposite angle theta-one $\Theta_1$ if the plane 124 of the seat 120 remains parallel to the floor 42; however, the seat 120 may be tilted somewhat more or less in the tilt direction or in a different plane depending on the position and comfort of the user 300.

FIGS. 3A-3F, as described above, show a variety of helical springs 91 that can be used for both the lower helical spring 70, the upper helical spring 90, or both, as part of the spring stool 10. FIG. 3A shows helical spring 91 formed as a helical coil 72 with a cross section $X_s$ of the helical coil material comprising a rectangular shape so as to form a rectangular wire compression spring, or a flat wire or rectangular wire compression spring. The spring 72, 91 comprises an inner diameter $D_i$ and an outer diameter $D_o$.

FIGS. 3B-3D show helical springs 91 comprise machined springs 93 that may comprise one or more of a connection member or adjusting mechanism 95 to couple the machined spring 93 or helical spring 91 to another member or feature, such as the connecting member 80, the base 20, legs 30, rotational joint 100, seat 120, or other similar feature.

FIGS. 3E and 3F show helical springs 91 comprise couplings, beam couplings, bellows couplings, and lattice couplings 94. Couplings 94 may comprise twin coupling ends or hubs 96 at opposing ends of the coupling 94. Couplings 94 may also comprise a corrugated tube or coupling body 97 made of metal, plastic, or other elastomeric material, and may be disposed between the twin coupling ends or hubs 96. The corrugated tube or coupling body 97 may provide for flexibility and lateral movement, like with conventional coil springs 92, but require more force to move a given distance. Couplings 94 may further comprise a connection member or adjusting mechanism 95.

By using a helical spring 91, including a coil spring 92, rather than a spring-loaded joint, elastomeric element, piston, or gas spring for the spring stool 10, there will often be less wear and degrading performance over time. Spring stool 10 may be provided with the helical springs 91 or coil springs 92 that may be open coil springs **92*a* or closed coil springs 92*b*. Open coil springs 92*a*, are springs that comprise spaces or gaps between the turns of the spring or between each successive turn or coil of the helix. Examples of open helical springs 92*a* are shown, e.g., in FIGS. 1, 2A-2C, 3A, and 3B as springs 90, 91, 92, and 93. Closed coil springs 92*b* are those springs that have successive turns, coils, or each successive turn of the helix touching without a space or gap between the turns of the spring when the spring is at rest. Examples of closed coil springs 92*b* are shown, e.g., in FIGS. 4B-4D**, and when deformed or loaded axially and not at rest may be opened to present spaces between successive turns or coils of the spring, which when unloaded may eliminate the gap or space and cause pinch points.

Providing spring stool 10 with the helical springs 91 or coil springs 92, including fixed ends, may also avoid, reduce, or minimize unwanted motion damping, heat buildup (such as in elastomers and gas springs), and noise generation or squeaking. Open helical springs **92*a* when formed as stiff springs with high lateral stiffness s may also reduce, minimize, or eliminate pinch points and loading in torsion that may be present with closed helical springs 92*b* or with springs 91 with low lateral stiffness. The coil springs 92 may include, provide, or exhibit minimal or very low friction, hysteresis, or both, compared to elastomeric counterparts, which in turn provides the user 300 freer more natural motion in response to applied forces. An additional benefit is no relative motion between parts means little or no noise from contact among moving parts and no lubrication maintenance or the mess associated with applying and applied lubrication. Helical springs 91 and in some instance more particularly heavy coil springs 92** with fixed ends as described herein (particularly when made of strong durable materials like steel) may have no moving parts (or multiple parts with relative movement with respect to each other) to wear out or require maintenance, and do not need to be replaced frequently like elastomeric joints.

FIGS. 4A-4D show additional detail with respect to casters or spring-loaded casters 50. As noted above, casters 50 may be coupled directly to a base 20, or when base 20 comprises legs 30, the caster may also be coupled to the legs 30. In some instances, each leg 30 will comprise a caster 50, while in other instances less than all the legs may comprise casters 50. In other instances, the legs 30 may comprise an arch or curve 31 that creates a space or hollow 32 for caster 50.

Figure 4A:
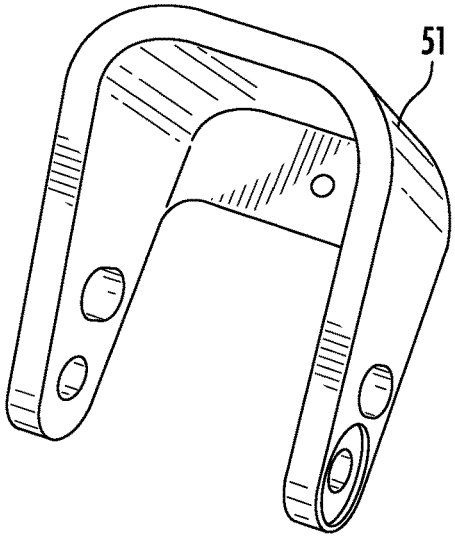
FIGS. 4A-4D show detail of a spring-loaded caster.

FIG. 4A shows a wheel housing 51 that can form a part of the caster 50, and provide a space for the wheel 52, structural support, and an attachment or mechanical fastening point for the spring-loaded components.

Figure 4B:
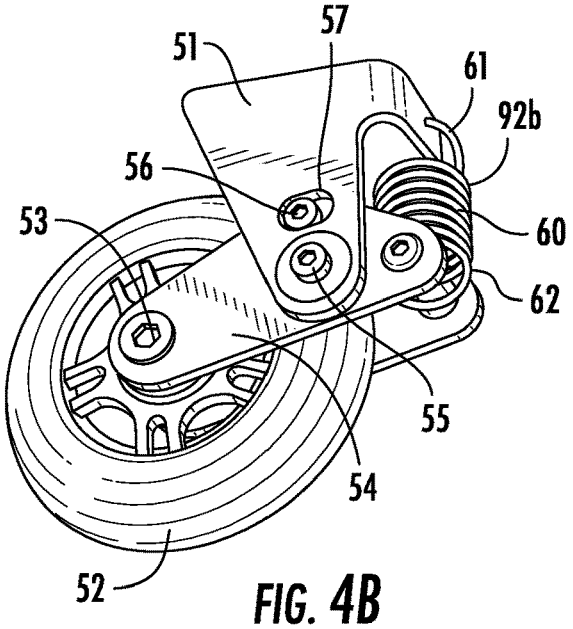

FIG. 4B shows the caster 50 with the wheel housing 51 further coupled to the wheel 52 with a wheel axel 53 passing through and supporting the wheel 52. The wheel axel 53 is coupled to a lever or height adjustment lever 54. The lever 54 is coupled to both the wheel housing 51 by a pin or fulcrum pin 55 between ends of the lever 54, the wheel axel disposed at a first end of the lever 54 and spring or caster spring 60 coupled to the second end of the lever 54 opposite the axel 53. The fulcrum pin 55 allows the lever 54 to pivot and for the wheel 52 to move up and down as the spring 60 is loaded (such as when user 300 sits on the stool 10 or seat 120). A range of motion of the lever 54 and the wheel 53 may be limited by a pivot stop 56 contacting a pivot stop opening 57 formed through a sidewall or portion of the wheel housing 51. An amount of movement of the lever 54 may be controlled by a spring constant k of the caster spring 60, the spring 60 comprising a first hook or first caster spring end 61 coupled to the wheel housing 51 and a second hook or second caster spring end 62 of the spring 60 coupled to the lever 54.

Figure 4C:
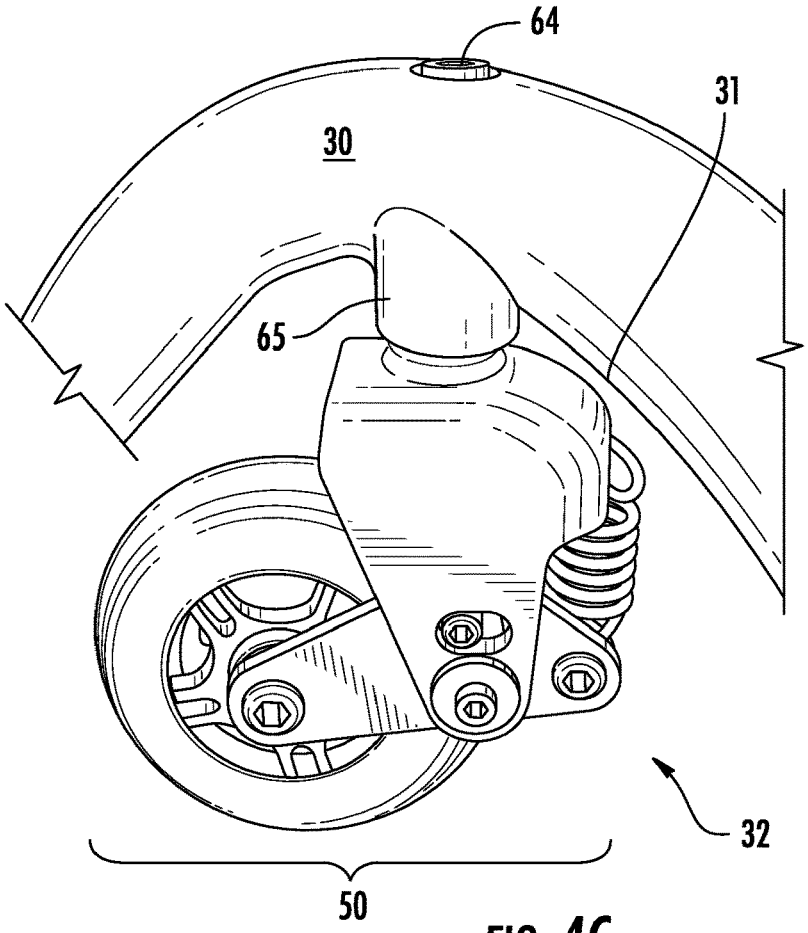

FIG. 4C shows the spring caster 50 of FIG. 4B coupled to a portion of a leg 30 with the leg comprising a caster attachment point 65 and a fastener or caster attachment bolt 64 coupling the caster 50 to the leg 30 at or within the space or hollow 32 under the arch or curve 31 in leg 30.

Figure 4D:
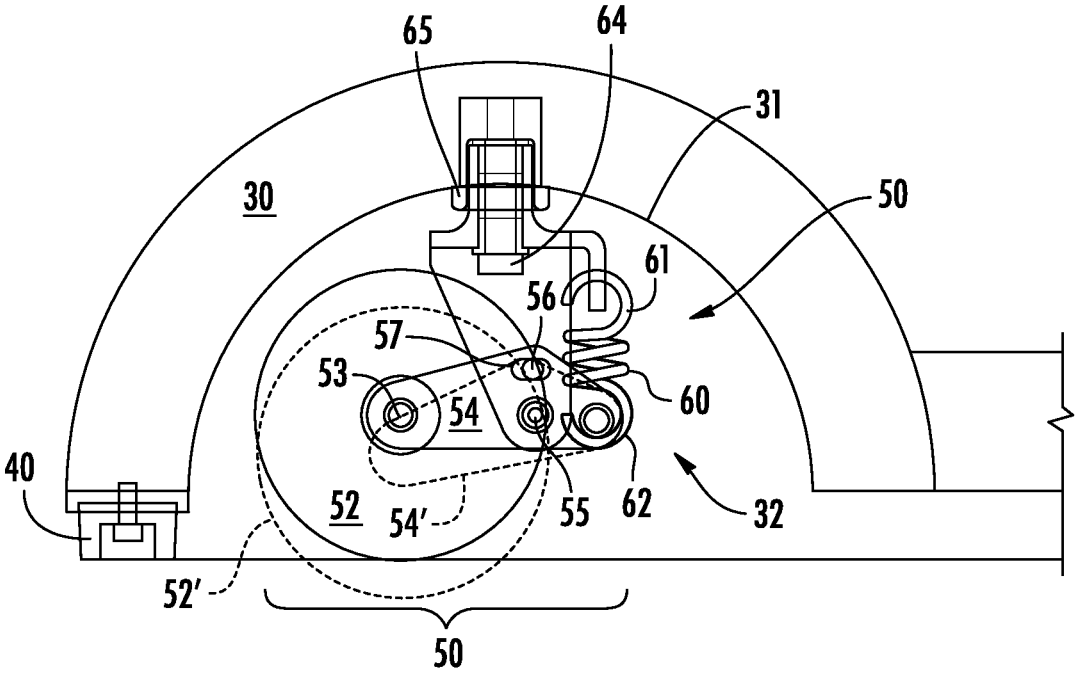

FIG. 4D shows how the spring-loaded casters 50 are configured for the wheel 52 to move from an initial wheel position 52' before loading spring 60 to retract when a user 300 is seated on the stool to allow the non-slip member(s) 40 to engage with the ground 42 and prevent the stool 10 from rolling. When the spring 60 is loaded, the spring may extend or lengthen and the lever 54 has been moved from its initial lever position 54' where it was disposed before loading of the spring 60. While FIG. 4D shows the member(s) 40 coupled, attached to, or directly contacting feet 30, the member(s) 40 may also be coupled, attached to, or directly contacting to the base 20 rather than the legs 30.

FIGS. 5A-5F show the head 304 of the user 300 remaining stationary, while the torso 302 of the user 300 moves in response to the position of the seat 120, the position of the seat responding to the movement of the lower helical spring 70, the upper helical spring 90, and the user 300.

Figure 5C:
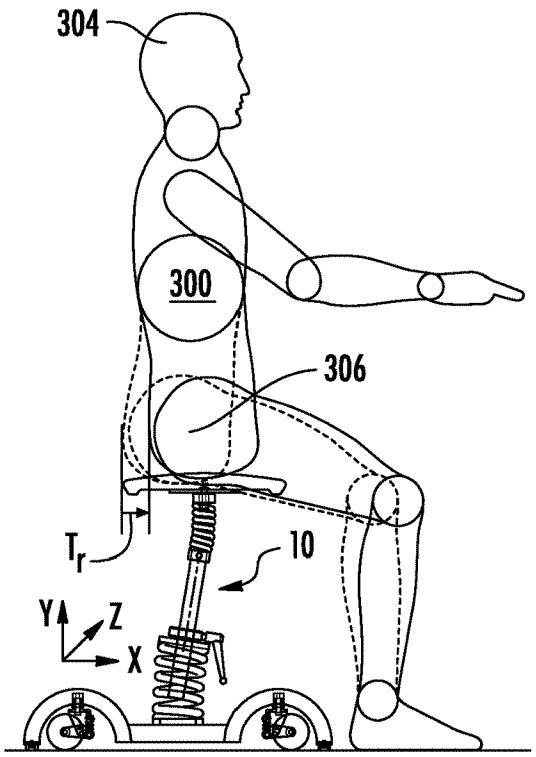
FIGS. 5A-5F show movement of a user on the spring stool.
Figure 5B:
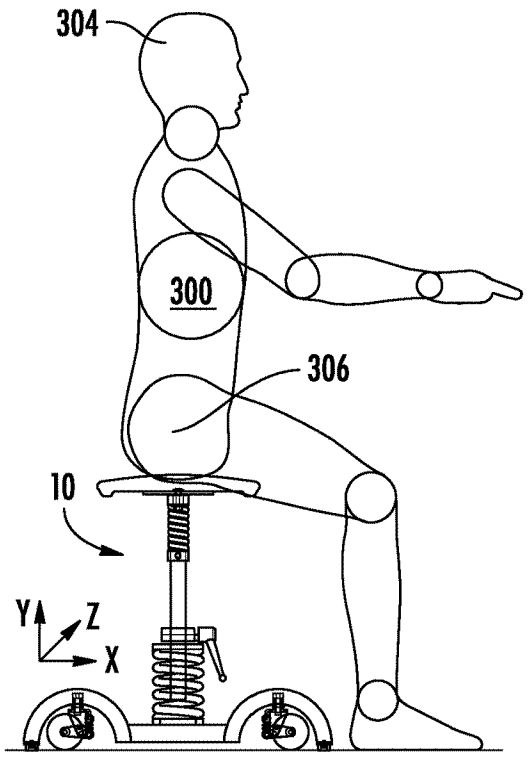
Figure 5A:
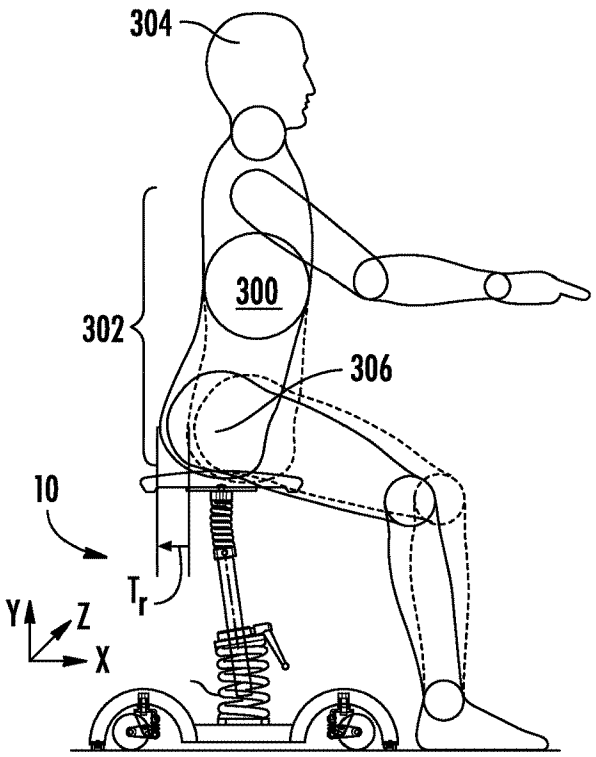

FIGS. 5A-5C show side profile views of the x-y plane with the user 300 seated on stool 10. FIG. 5A shows the user 300 with a negative or rearward translation $T_r$ and the lower core 302 and buttocks 306 of the user 300 shifted backwards, while the head 304 of the user remains stationary. FIG. 5B shows the user 300 seated at rest or in a neutral position without the stool 10 undergoing any lateral loading or translation $T_r$. in any x-direction or z-direction. FIG. 5C shows the user 300 with a positive or forward translation $T_r$ and the lower core 302 and buttocks 306 of the user 300 shifted forward, while the head 304 of the user remains stationary.

Figure 5F:
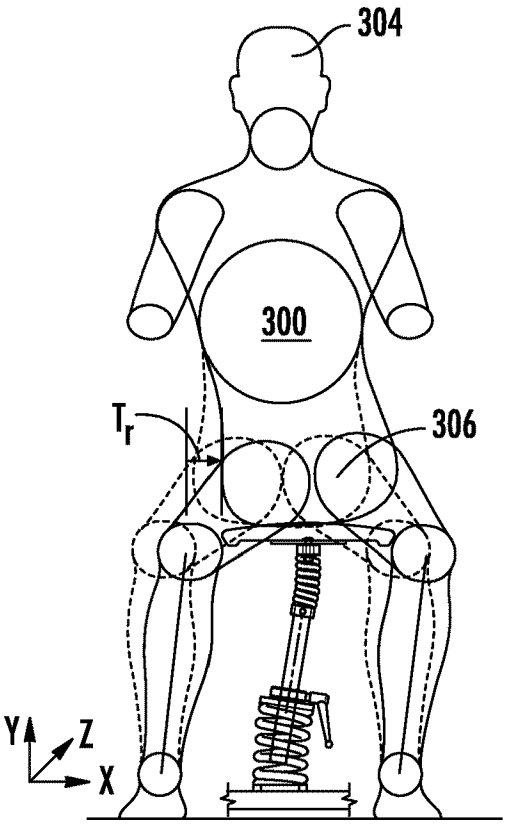
Figure 5E:
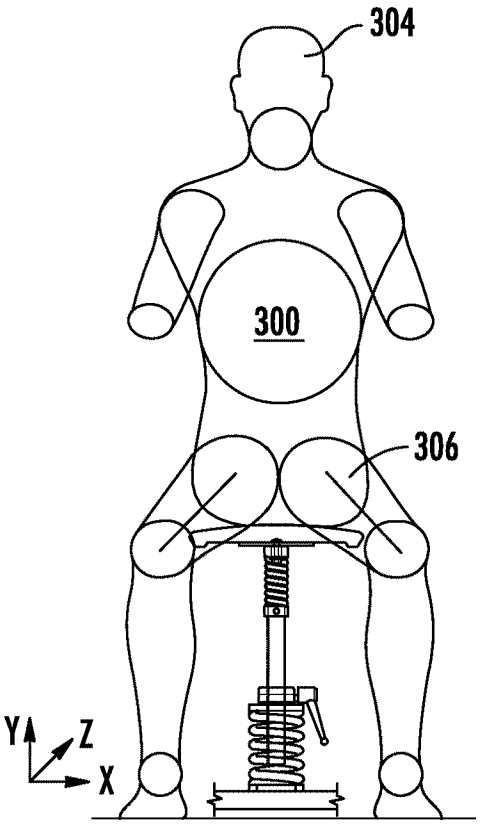
Figure 5D:
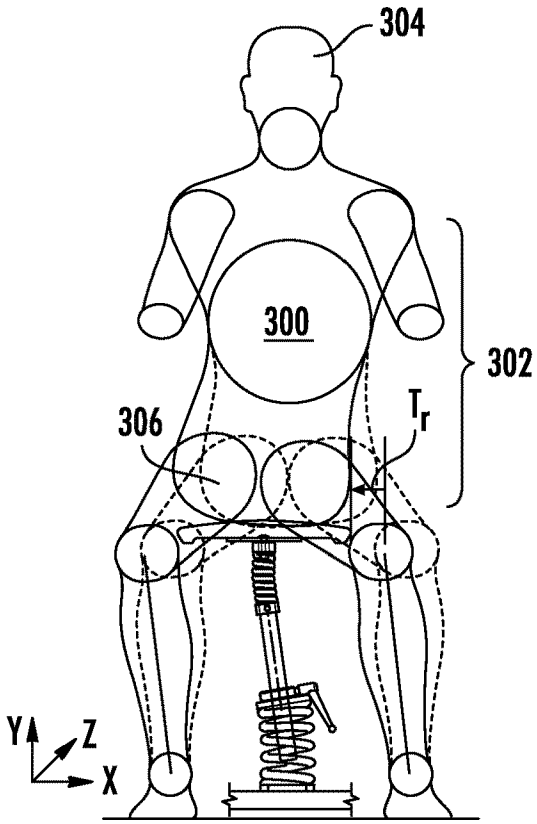

FIGS. 5D-5F show front or rear profile views of an x-y plane with the user 300 seated on stool 10. FIG. 5D shows the user 300 with a negative or leftward translation $T_r$ and the lower core 302 and buttocks 306 of the user 300 shifted leftward in the FIG., while the head 304 of the user remains stationary. FIG. 5B shows the user 300 seated at rest or in a neutral position without the stool 10 undergoing any lateral loading or translation $T_r$. in any x-direction or z-direction. FIG. 5C shows the user 300 with a positive or rightward translation $T_r$ and the lower core 302 and buttocks 306 of the user 300 shifted rightward, while the head 304 of the user remains stationary.

Figure 6A:
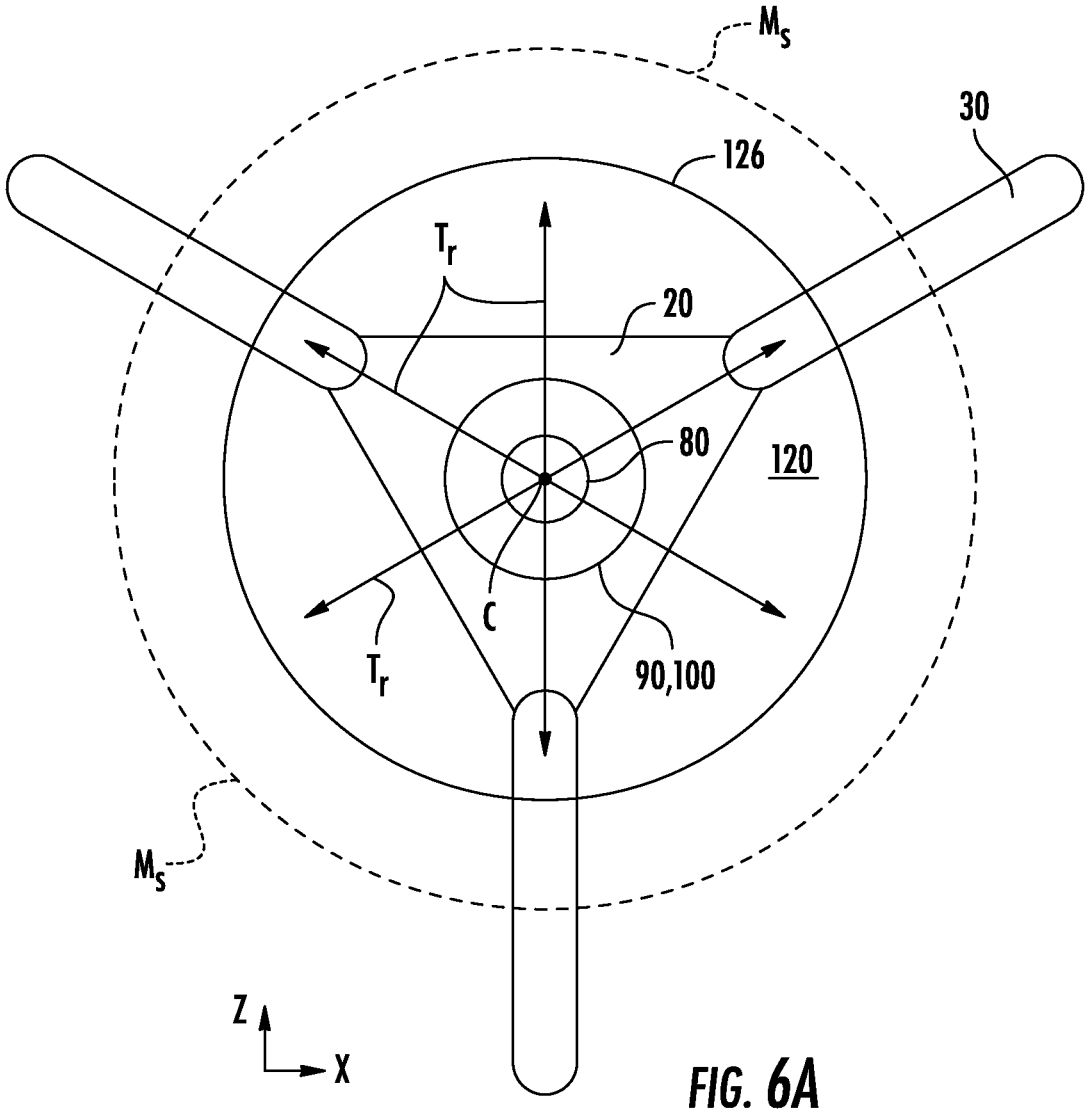
FIGS. 6A and 6B show an approximate limit of safe movement for the spring stool.
Figure 6B:
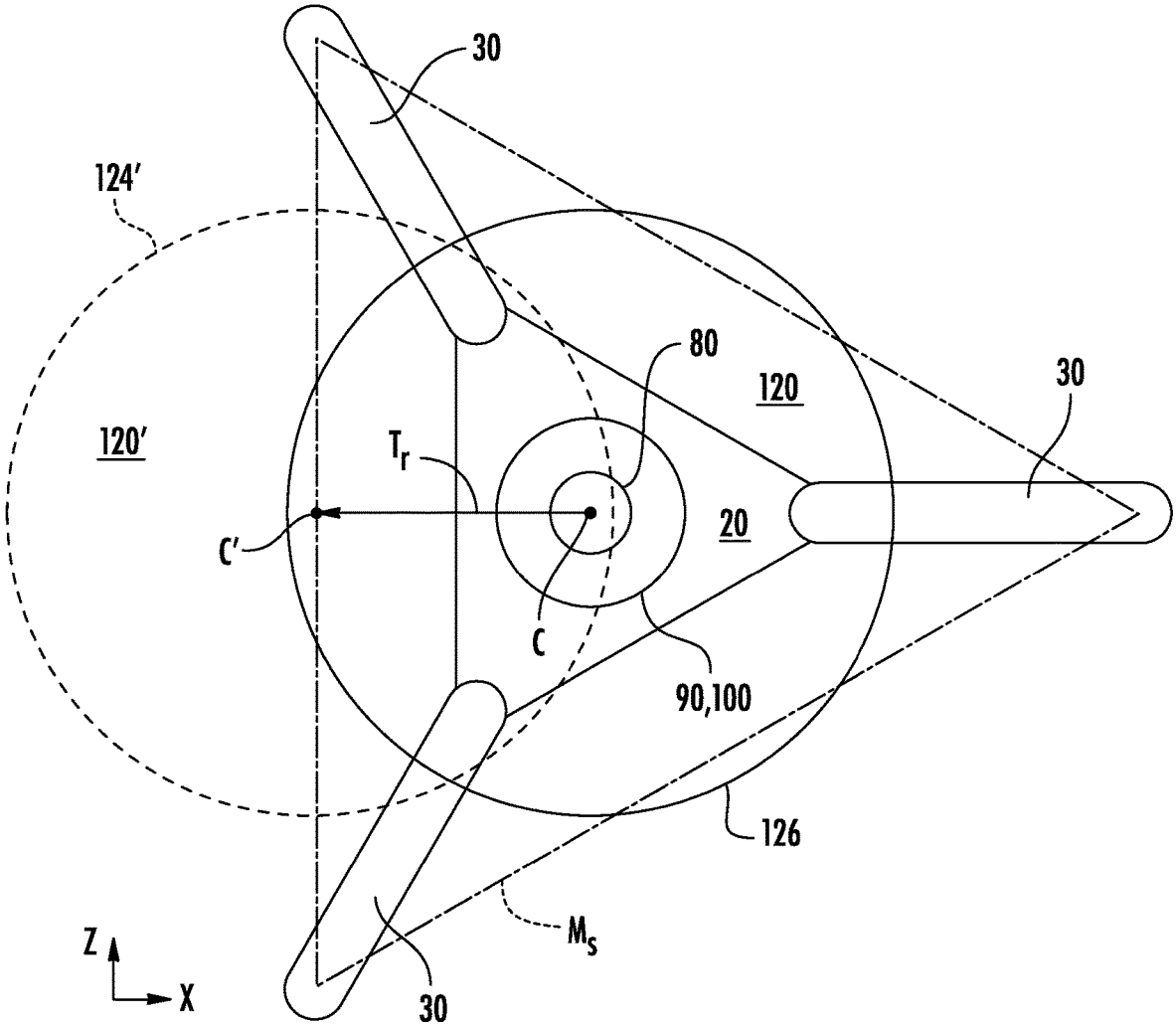

FIGS. 6A and 6B show top or plan views of a footprint of the stool 10 as seen when looking down towards the floor 42. FIG. 6A shows the seat 120 in a neutral, unloaded, or at rest position, with no translation $T_r$, and further shows an approximate limit of safe movement $M_s$.

FIG. 6B shows the seat 120 in a loaded or translated position 120' having undergone translation $T_r$, such that the translated center C' of the seat 120 is at a limit or approximate limit of safe movement $M_s$. while the perimeter of outer edge 126 of seat 120 is past the approximate limit of safe movement $M_s$. The approximate limit of safe travel $M_s$ for the center C of the seat 120 may be a polygon defined by the contact points of the nonslip member(s) 40 with the floor 42. Beyond the approximate limit of safe movement $M_s$ there's greater chance of the stool tipping. The approximate limit of safe travel $M_s$ may be changed by the quantity and position of legs 30 or nonslip member(s) 40 included with the stool 10. The approximate limit of safe movement $M_s$. is approximate because a center of gravity of the user 300 may or may not be is directly over the center C of the seat 120, and because in many instances the force the user 300 applies to the seat 120 will not be an entirely vertical vector.

Figure 7A:
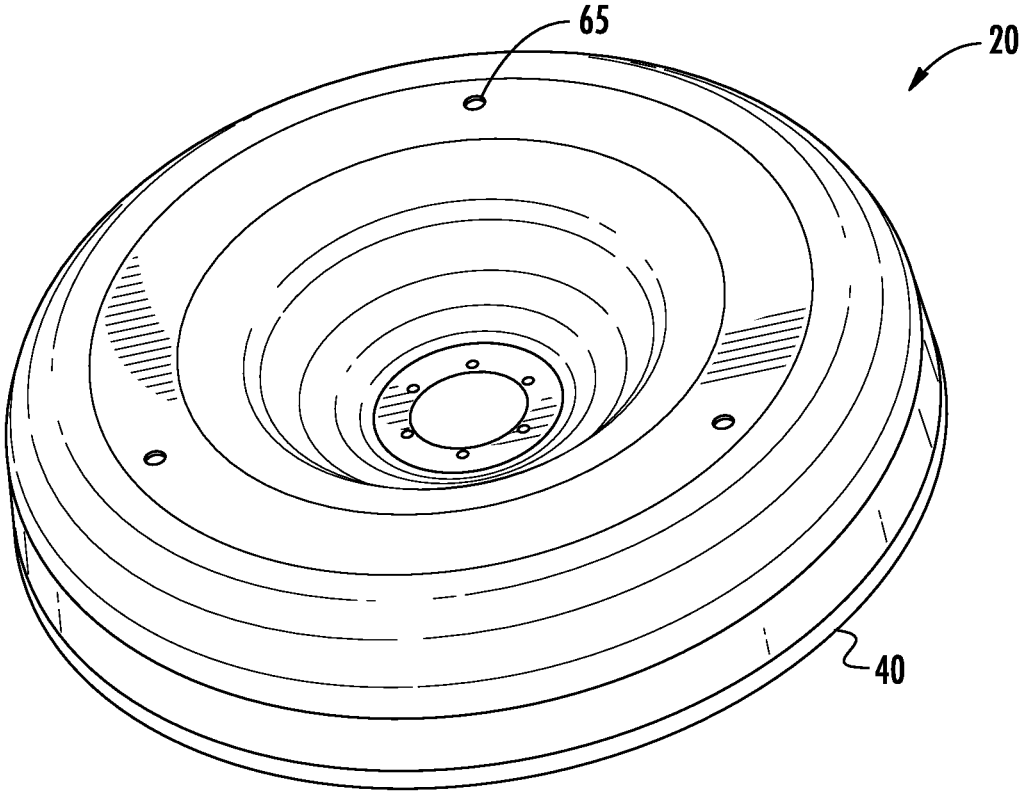
FIGS. 7A and 7B show various views of a base that also serves as legs for the spring stool.
Figure 7B:
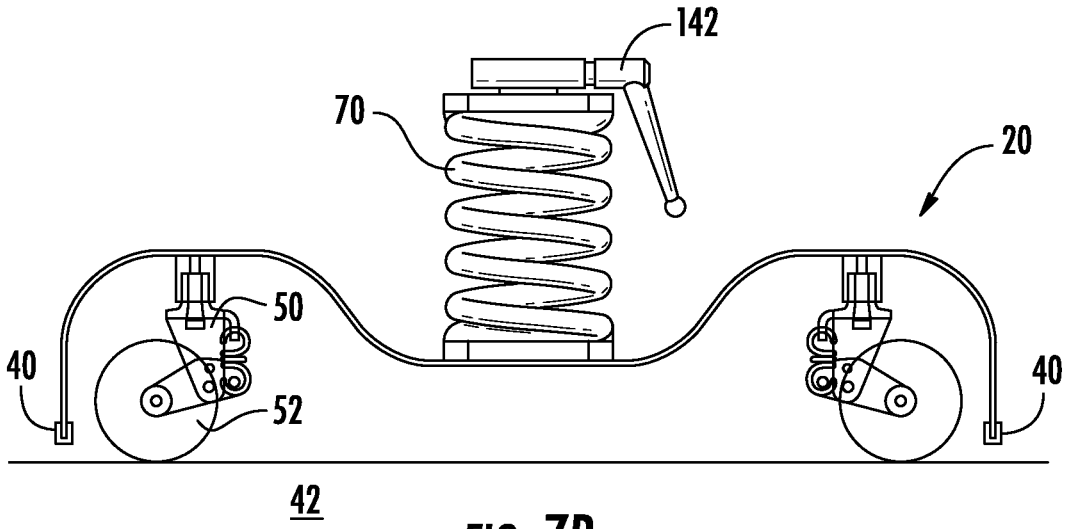

FIGS. 7A and 7B show various views of base 20, when base 20 is constructed without legs 30 coupled to the base 20. FIG. 7A shows a perspective view of a top side of the base 20, the base 20 being formed without separate legs. The base 20 comprises caster attachment points 65 for coupling to the casters 50 without separate legs 30. The base 20 may be formed of a single, unitary, or integrally formed member, such as a sheet of pressed, molded, stamped, or joined metal or other suitable material. The base 20 may contact the floor 42, such as through non-slip member 40. The non-slip member 40 may be formed of one or more members or pieces, and in some instances may be a single continuous strip of material, such as rubber edging as is shown in FIGS. 7A and 7B.

FIG. 7B shows a cross-sectional profile view of the base 20 from FIG. 7A coupled to non-slip member 40, casters 50, and lower helical spring 70.

In accordance with the foregoing, the stool 10 provides and facilitates safe and healthy movement of the core 302 of the user 300, including the spine, and translational movement $T_r$ of the seat 120 while reducing, minimizing, or limiting axial movement of the stool 10 and of the user 300, such as to, or about, a range of 0.5-5 cm or 1-4 cm.

As a result, the user 300 may more easily maintain focus during tasks requiring concentration, such as computer-related tasks. Furthermore, instead of merely having the seat 120 of the stool 10 tilt Tt away from the base 20—such as by enabling tilt and counter-tilt as shown in FIG. 2C and FIGS. 5A-5F—the point of contact between the person's pelvis and the seat need not change, reducing a risk the user 300 may fall off the stool 10. Additionally, a potentially acute compensating bend in the core 302 and spine of the user 300 may be avoided, further reducing a risk of injury to the user 300.

Where the above examples, embodiments and implementations reference examples, it should be understood by those of ordinary skill in the art that other seating and manufacturing devices and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation.

In places where the description above refers to particular embodiments of a spring stool, it should be readily apparent that a number of modifications may be made without departing from the spirit thereof. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. A stool, comprising:

a base comprising at least three legs with each leg comprising a non-slip member;

a spring-loaded caster coupled to each of the at least three legs;

a lower helical spring coupled to the base;

a connecting member comprising a first end coupled to the lower helical spring, a second end opposite the first end, and a central axis that extends between the first end and the second end, wherein the lower helical spring coupled to the connecting member is configured to permit lateral movement of the first end of the connecting member while the base remains static;

an upper helical spring coupled to the second end of the connecting member;

a rotational joint coupled to the upper helical spring;

a seat coupled to the rotational joint and configured to rotate about the central axis of the connecting member, and wherein the base, lower helical spring, upper helical spring, rotational joint, and seat share a common vertical axis with the central axis of the connecting member when at rest.

2. The stool of claim 1, further comprising a lateral stiffness (s) of the lower helical spring being greater than a lateral stiffness (s) of the upper helical spring.

3. The stool of claim 1, wherein the connecting member further comprises an adjustable length that adjusts a height of the seat.

4. The stool of claim 3, wherein the connecting member further comprises a clamp collar and handle coupled to a top of lower helical spring such that a portion of connecting member may extend into an open center of lower helical spring to reduce a length of the connecting member disposed between the clamp collar and the seat to reduce the height of the seat.

5. The stool of claim 1, wherein the seat further comprises a lip to facilitate movement or positioning of the stool by a user.

6. The stool of claim 1, wherein spring-loaded casters are configured to retract when a user is seated on the stool to allow the non-slip member to engage with the ground and prevent the stool from rolling.

7. The stool of claim 6, wherein:

the lower helical spring is configured to tilt in a first direction when loaded by a user; and the upper helical spring is configured to counter-tilt in a second direction substantially opposite to the first direction.

8. A stool, comprising:

a base;

a lower helical spring coupled to the base;

a connecting member comprising a first end coupled to the lower helical spring, a second end opposite the first end, and a central axis that extends between the first end and the second end, wherein the lower helical spring coupled to the connecting member is configured to permit lateral movement of the first end of the connecting member;

an upper helical spring coupled to the second end of the connecting member;

a rotational joint coupled to the upper helical spring;

a seat coupled to the rotational joint such that the seat rotates about the central axis of the connecting member, and the base, lower helical spring, upper helical spring, rotational joint, and seat share a common vertical axis with the central axis of the connecting member when at rest.

9. The stool of claim 8, further comprising a lateral stiffness (s) of the lower helical spring being greater than a lateral stiffness (s) of the upper helical spring.

10. The stool of claim 8, wherein the base comprises at least three legs comprising a non-slip member.

11. The stool of claim 8, wherein the base comprises at least one spring-loaded caster.

12. The stool of claim 8, wherein the connecting member further comprises an adjustable length that adjusts a height of the seat.

13. The stool of claim 12, wherein the connecting member further comprises a clamp collar and a handle coupled to a top of the lower helical spring such that a portion of connecting member may extend into an open center of the lower helical spring to reduce a length of the connecting member disposed between the clamp collar and the seat to reduce the height of the seat.

14. The stool of claim 8, wherein the seat further comprises a lip to facilitate movement or positioning of the stool by a user.

15. A stool, comprising:

a base;

a lower helical spring coupled to the base;

a connecting member comprising a first end coupled to the lower helical spring, a second end opposite the first end, and a central axis that extends between the first end and the second end, wherein the lower helical spring coupled to the connecting member is configured to permit the connecting member to tilt at the lower helical spring;

an upper helical spring coupled to the second end of the connecting member;

a seat coupled to the upper helical spring.

16. The stool of claim 15, further comprising a lateral stiffness (s) of the lower helical spring being greater than a lateral stiffness (s) of the upper helical spring.

17. The stool of claim 15, wherein the base comprises:

at least three legs comprising feet; and at least one spring-loaded caster coupled to the base.

18. The stool of claim 15, further comprising:

a rotational joint coupled to the upper helical spring; and the seat coupled to the rotational joint such that the seat rotates about the central axis of the connecting member.

19. The stool of claim 15, wherein the connecting member further comprises an adjustable length that adjusts a height of the seat.

20. The stool of claim 19, wherein the connecting member further comprises a clamp collar and a handle coupled to a top of the lower helical spring such that a portion of the connecting member may extend into an open center of the lower helical spring to reduce a length of the connecting member disposed between the clamp collar and the seat to reduce the height of the seat.

* * * * *